United States Patent [19]

Williams

[11] 4,378,036

[45] Mar. 29, 1983

[54] WOODMASTER

[76] Inventor: Ray J. Williams, P.O. Box 202029, Dallas, Tex. 75220

[21] Appl. No.: 218,523

[22] Filed: Dec. 22, 1980

[51] Int. Cl.[3] ..... B27L 7/00

[52] U.S. Cl. ..... 144/193 R; 83/104; 83/620; 144/193 D; 144/366; 241/79.3

[58] Field of Search ..... 144/193 R, 193 A, 216, 144/217, 193 D, 366, 363; 83/104, 620, 628, 685, 686; 241/79.3

[56] References Cited

U.S. PATENT DOCUMENTS

| | | | |
|---|---|---|---|
| 521,769 | 6/1894 | Riemann | 144/217 |
| 2,237,078 | 4/1941 | Lilly | 241/79.3 |
| 3,216,469 | 11/1965 | New | 144/193 X |
| 3,614,003 | 10/1971 | Tremulada | 241/79.3 |
| 4,014,232 | 3/1977 | Mauger | 83/628 |

*Primary Examiner*—W. D. Bray

*Attorney, Agent, or Firm*—Dennis T. Griggs

[57] ABSTRACT

A cutter assembly for automatically splitting wood discs to produce wood chunks of an appropriate size for outdoor cooking is disclosed. The wood discs are sheared into wedge portions by a knife assembly which is reciprocated by a crank assembly which converts the rotary motion of a power shaft to reciprocating motion of a yoke coupled to the knife assembly. Wedge segments of the wooden discs are forcefully discharged into a rotary hopper by the action of a wedge cutting portion of the knife assembly which includes a deflection face which is forwardly inclined with respect to the plane of motion of the cutting edge of the knife.

1 Claim, 6 Drawing Figures

WOODMASTER

BACKGROUND OF THE INVENTION

1. Field of the Invention:

The present invention relates to apparatus for splitting wood, and in particular, to an automatic cutter assembly for shearing chunks from discs of wood.

2. Description of the Prior Art:

Wood has long been used as a fuel for heating and cooking purposes. Millions of cords of wood are used for fuel each year in the United States. In the early history of the United States, wood was the most common source of fuel for cooking. Today, certain aromatic woods such as walnut, hickory and mesquite are still used for outdoor cooking, barbequeing and the like. Such woods are preferred because of the flavor imparted to the food by the wood smoke. Charcoal briquettes are more commonly used as a fuel for outdoor cooking, but are not aromatic. Consequently, according to personal preference, hickory, walnut or mesquite wood is still being used for outdoor cooking, either alone or in combination with charcoal briquettes.

Aromatic wood such as hickory, walnut and mesquite is closed grained and difficult to split. For example, walnut has a shearing strength, parallel to grain, in excess of 1,000 psi. Thus, it is difficult to manually cut and split chunks of wood to the small size needed for outdoor cooking purposes. The wood chunks are preferably cut to approximately the same size as commercially available charcoal briquettes for obtaining a slow burning, even source of heat for cooking purposes. One of the limitations to commercializing aromatic woods in competition with charcoal briquettes has been the lack of a machine which can automatically split the wood into chunks of appropriate size on a mass production basis. It will be appreciated that the process can be carried out by the individual user by hand if he so chooses, but to reach a large market, an automatic cutter assembly for producing the wood chunks is essential.

OBJECTS OF THE INVENTION

It is, therefore, the principal object of the present invention to provide a cutter assembly for automatically producing wood chunks of an appropriate size for outdoor cooking.

A related object of the invention is to provide a knife assembly for use on an automatic cutter for automatically splitting wood chunks and discharging them through a conveyor tray.

SUMMARY OF THE INVENTION

The foregoing objects are achieved in the present invention by a cutter assembly which shears a disc of wood into multiple wedge segments. According to the method of the invention, a log of an aromatic wood such as hickory, walnut or mesquite is pre-cut (cross-grain) to produce a disc of wood having a thickness which corresponds to a desired dimension for a wood chunk. Thereafter, the disc of wood is conveyed to a splitting station where it is sheared parallel to the grain into multiple wedge segments by a knife having multiple blade portions.

According to a preferred embodiment of the invention, the knife includes a wedge cutting portion having a deflection face which converges to define a cutting edge, and which is forwardly inclined relative to the plane of motion of the cutting edge wherein the wood chunks are discharged forwardly away from the knife as a result of the shearing action.

Automatic splitting of the wood discs is achieved by mounting the knife upon a ram which is driven reciprocally by a rotatable power shaft. The rotary motion of the power shaft is converted to reciprocating motion of a yoke by a crank assembly. The upper end of the yoke is pivotally coupled to the ram, and its lower end is rotatably coupled to the crank assembly.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawings.

DETAILED DESCRIPTION OF THE PREFERRED EMBODIMENTS

Figure 1:
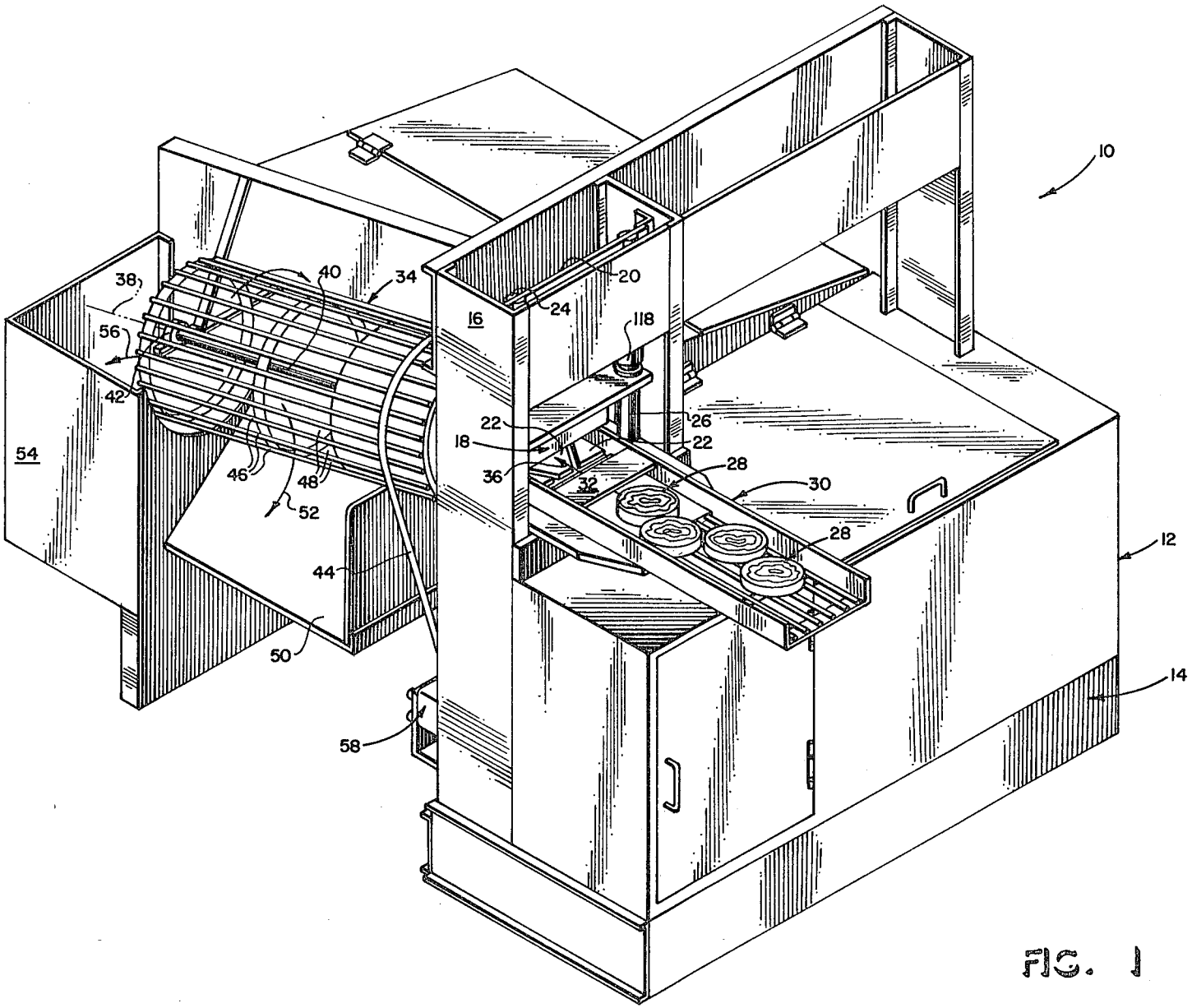
FIG. 1 is a perspective view of a cutter assembly for automatically splitting wood chunks from discs of wood.

In the description which follows, like parts are marked throughout the specification and drawings with the same reference numerals, respectively. The drawings are not necessarily to scale and in some instances portions have been exaggerated in order to more clearly depict certain features of the invention.

Figure 4:
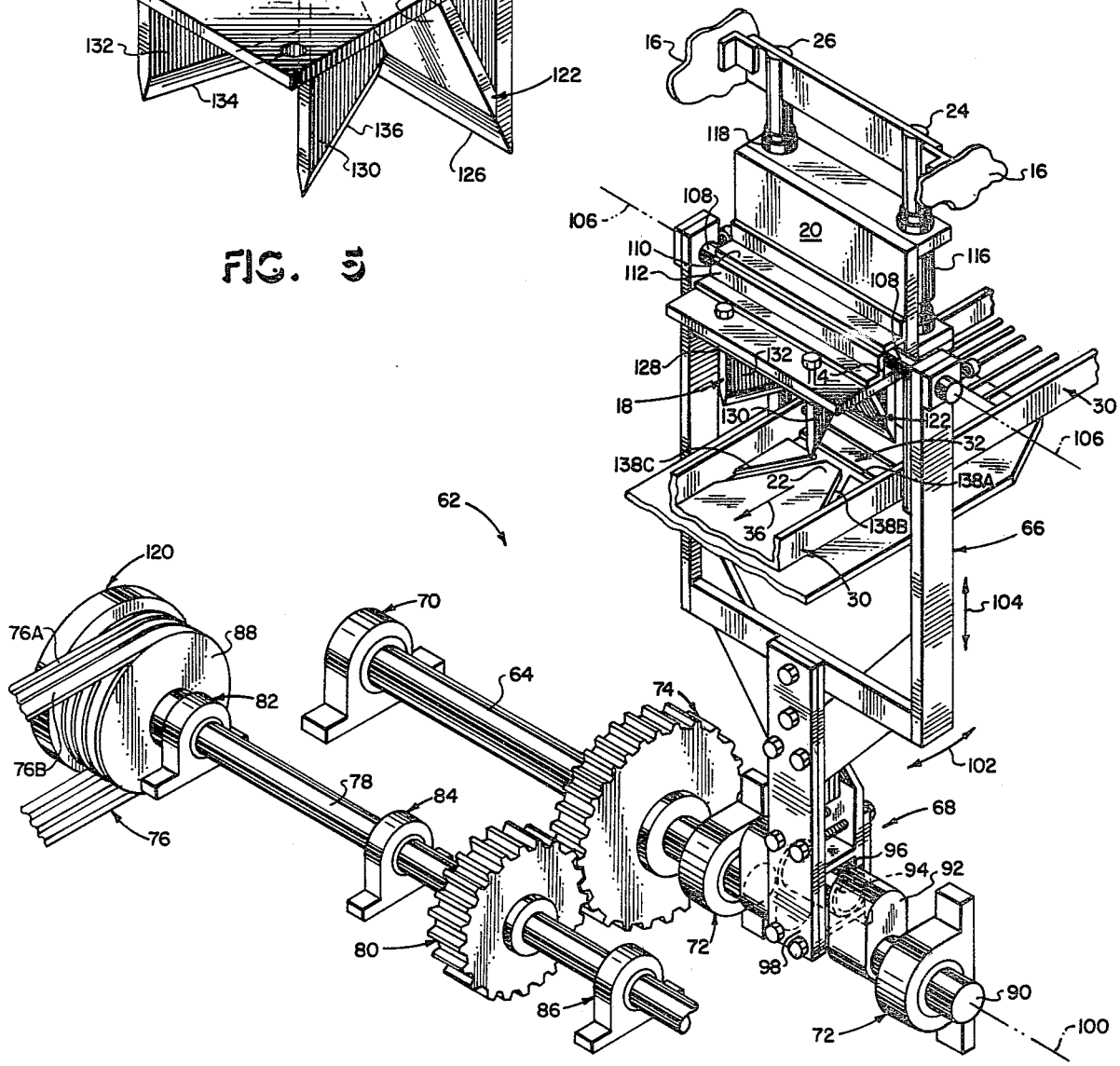
FIG. 4 is a perspective view which illustrates the power transmission and knife drive apparatus of the cutter assembly of FIG. 1.

Referring now to FIGS. 1 and 4, the invention is embodied in a cutter assembly 10 which is enclosed within a housing 12. The housing 12 rests upright on a base platform 14. Enclosed within a superstructure 16 of the housing is a knife assembly 18. The knife assembly 18 is carried by a ram 20 in reciprocal motion above a shear plate 22. The ram is guided on posts 24, 26 located on opposite sides of the shear plate 22. Wood discs 28 are carried by a conveyor tray 30 into the path of movement of the knife assembly 18. At that location, which will be referred to generally as a splitting station 32, the wood discs are split by the shearing action of the knife assembly 18. The wedge-shaped chunks are discharged into a rotary hopper 34 as indicated by the arrow 36.

The rotary hopper 34 is coupled to the conveyor tray 30 and is supported for rotation about an inclined axis 38. Preferably, the rotary hopper 34 is supported on a shaft 40 which is journalled at opposite ends in bearings 42. The hopper 34 is rotated by a drive belt 44. The sides of the hopper are enclosed by slats 46 which are equally spaced around the periphery of the hopper. The slat spacing 48 is chosen for separating out wood portions of less than a predetermined maximum size, for example small chips, splinters, bark and the like. The undersized material falls through the elongated side wall openings 48 between the slats and is conveyed downwardly along a slide 50, as indicated by the arrow 52, into a suitable container (not shown). The remaining wood chunks of the preferred size are discharged out of the lower open end of the hopper into a bagging station 54 as indicated by the arrow 56.

Figure 2:
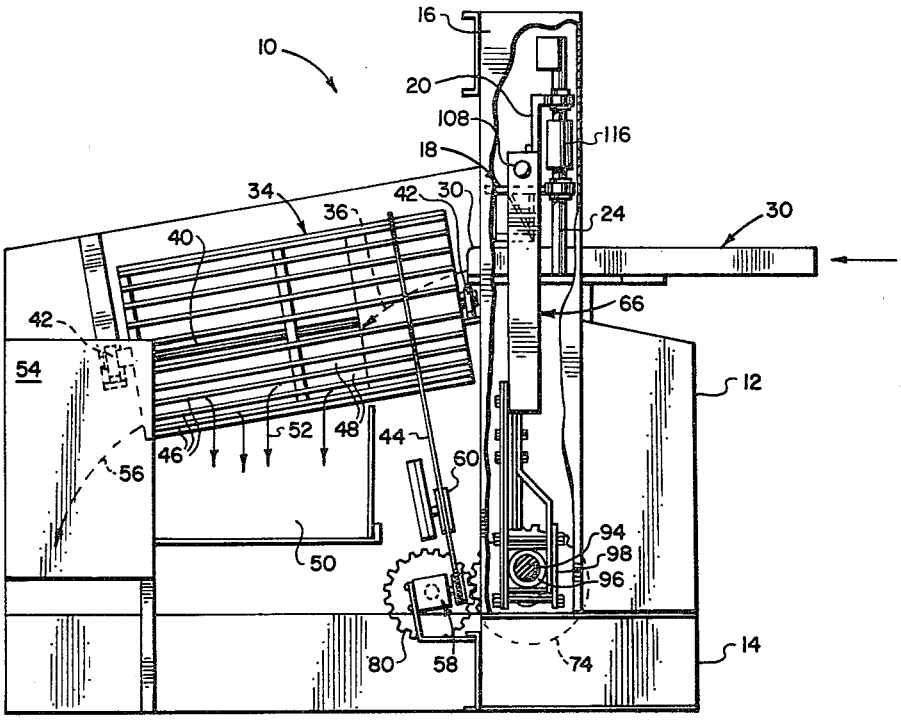
FIG. 2 is a left-side elevation view, partly broken away, of the cutter assembly shown in FIG. 1.
Figure 3:
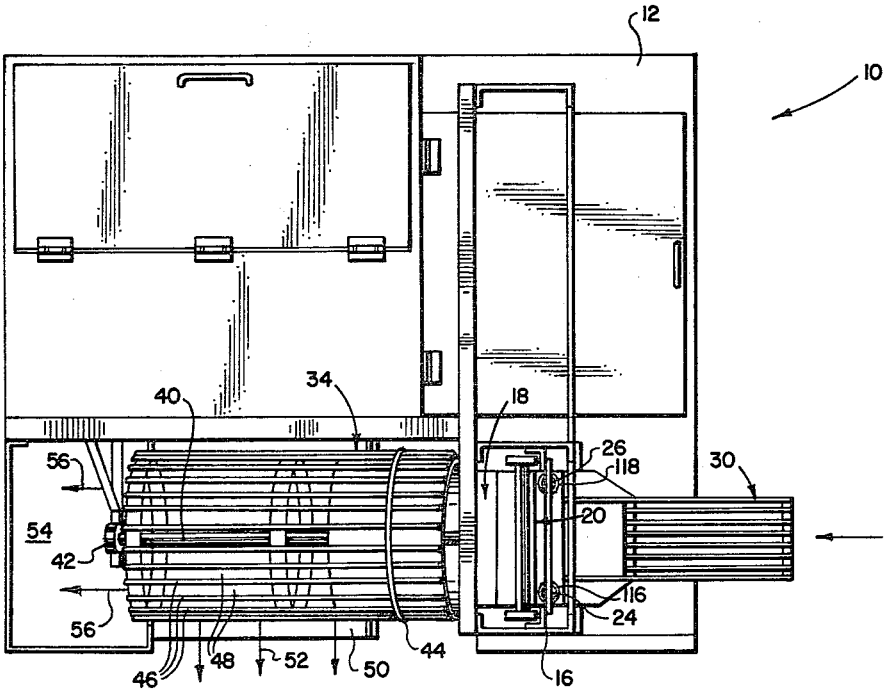
FIG. 3 is a top plan view of the cutter assembly shown in FIG. 1.

The wood chunks are tumbled about within the rotary hopper for a short while before they are discharged through the lower end. Rotary motion is imparted to the hopper 34 by the belt 44 which is driven by an electric motor 58. The correct tension is maintained in the belt 44 by an adjustable idler pulley 60 (FIG. 2).

Because of the relatively high shearing strength of aromatic wood, the knife assembly 18 must be driven relatively forcefully to obtain clean and positive shearing action and to forcefully eject the sheared chunks along the conveyor tray 30. For reasons of floor space economy, the driving apparatus should be capable of being arranged in working order within a compact volume. One such compact power transmission assembly 62 is illustrated in FIG. 4. According to that arrangement, the ram 20 is driven reciprocally in vertical up-and-down motion above the shear plate 22 by a main power shaft 64. The ram 20 is coupled to the main power shaft 64 through a yoke 66 and a crank assembly 68. The rotary motion of the main power shaft 64 is converted to reciprocating motion of the yoke 66 by the crank assembly 68. The upper end of the yoke 66 is pivotally coupled to the ram 20, and its lower end is rotatably coupled to the crank assembly 68.

The main power shaft 64 is supported at opposite ends by bearings 70, 72. Rotary motion is imparted to the main power shaft 64 through a driven gear 74. The prime mover for the cutter assembly 10 is preferrably an electrical motor (not shown) which is coupled to the main power shaft 64 by a belt drive assembly 76, an intermediate power shaft 78 and pinion gear 80. The intermediate drive shaft 78 is supported in parallel relation with the main power shaft 64 on journal bearing assemblies 82, 84 and 86. The drive belt assembly 76 preferrably includes at least two drive belts 76A, 76B, which are reeved on a drive pulley 88. Rotary motion of the intermediate drive shaft 78 is transmitted to the main power shaft 64 by the pinion 80 which is meshed with the driven gear 74.

The rotary motion of the main power shaft 64 is transmitted to the yoke assembly 66 by the crank assembly 68. The crank assembly includes a crank shaft 90, a radially extending crank arm 92 and a crank pin 94 which projects from the crank arm in parallel offset relation with the crank shaft 90.

As can best be seen in FIGS. 2 and 4, the crank pin 94 is rotatably journalled within a sleeve bearing 96. The sleeve bearing 96 preferably comprises a soft metal such as bronze and is lodged within a lock plate assembly 98 at the lower end of the yoke assembly 66. According to this arrangement, the crank pin 94 is displaced with respect to, and turns about, the axis 100 of the crank shaft 90. The result of the offset rotation of the crank pin 94 around the axis 100 is to transform the rotary motion of the main power shaft 64 into reciprocating motion of the yoke 66. Thus, the knife assembly 18 is driven in one up-and-down cycle for each complete rotation of the main power shaft 64.

Now referring to FIG. 4, because of the offset relation of the crank pin with respect to the crank shaft, the yoke 66 undergoes slight pendulous motion as indicated by the arrow 102 at the same time that it is undergoing up-and-down movement as indicated by the arrow 104. The yoke assembly 66 thus swings back and forth slightly with respect to a pivotal axis 106. To accommodate this pivotal movement, the yoke is pivotally coupled to the ram 20 by a pivot bar 108. The pivot bar 108 extends through a rectangular channel bounded by the ram 20, the upper side of the knife assembly 18 and an additional pair of plates 110, 112. The pivot bar 108 is freely rotatable within the channel space 114 while at the same time transmitting either a downwardly directed or upwardly directed force in response to reciprocal motion of the yoke assembly 66.

The reciprocal movement of the ram 20 is guided by the guide posts 24, 26 (FIG. 1). The guide posts 24, 26 are mounted on the shear station housing on opposite sides of the shear plate 22 in parallel relation with the plane of movement of the ram 20. The ram 20 is coupled to the guide posts by guide sleeves 116, 118 which are slidably received around the guide posts 24, 26, respectively. The slidable engagement of the guide sleeves with the guide posts stabilizes the reciprocal movement of the ram as it is driven into shearing engagement with a disc of wood 28.

It will be appreciated that because of the relatively high shearing strength of the wood discs, that the knife assembly 18 must be driven with considerable force to achieve clean, positive splitting action. Accordingly, a large amount of energy is expended as the cutting edge of the knife assembly 18 initially penetrates the grain of the disc. Such relatively high impulse loading can in some circumstances exceed the rated load capacity of the prime mover. To accommodate such impulse loading and to generally increase the shearing ability of the cutter assembly 10, a relatively large, massive fly wheel 120 (FIG. 4) is secured to the intermediate drive shaft 78. The rotary kinetic energy stored in the rotating fly wheel 120 is immediately available to accommodate the relatively high impulse loading.

For relatively high production output, it is important that the wood discs 28 move through the splitting station 32 at a relatively continuous flow rate which is coordinated with the shearing movement of the blade 18. Thus, it is important that the wood chunks be cleared automatically from the splitting station so that new discs may be received on the shear plate 22. Because a relatively high cycle rate for the knife assembly 18 is desired, the interval available for clearing the splitting station during retraction of the knife assembly is relatively short. Thus, it is preferred that the wood chunks be discharged aautomatically from the splitting station at the time the shearing action is taking place. Accordingly, the knife assembly 18 is provided with a wedge cutting portion 122 having a deflection face 124 which converges to define a cutting edge 126. Moreover, the deflecting face 124 is forwardly inclined relative to the plane of motion of the cutting edge 126, whereby a forwardly directed force is imparted to the wood chunks as they are split, thereby causing them to be discharged through the tray 30 as indicated by the arrown 36 in FIG. 4.

Figure 6:
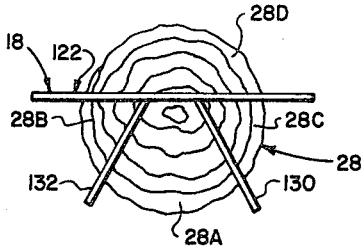
FIG. 6 is a plan view of a wood disc onto which the cutting pattern of the knife assembly of FIG. 5 has been superimposed.

Preferrably, each wood disc 28 is split into at least four portions 28A, 28B, 28C, and 28D, as indicated in FIG. 6. This produces generally wedged-shaped segments or chunks, which are of an appropriate size and configuration for outdoor cooking.

Figure 5:
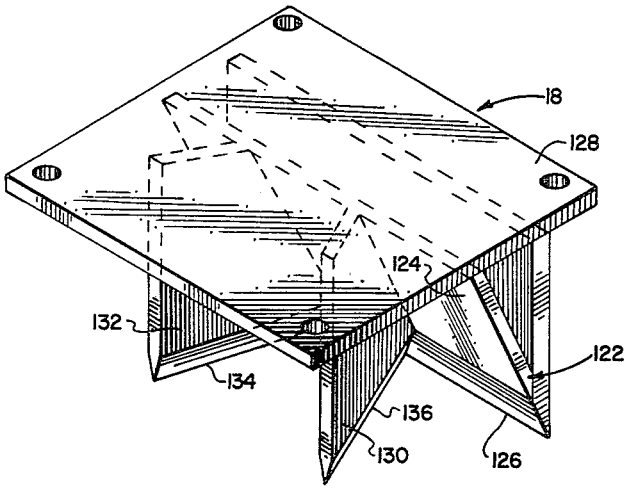
FIG. 5 is a perspective view of a knife assembly.

The shearing pattern indicated in FIG. 6 is produced by the knife assembly as illustrated in FIG. 5. According to that arrangement, the knife assembly 18 includes a base plate 128 from which the wedge cutting portion 122 downwardly depends. In order to produce multiple chunks in one shearing stroke, an additional set of blades 130, 132 are attached to the underside of the base plate 128, and are joined, preferrably by welding, to the wedge cutting portion 122. The blade portions each have a cutting edge 134, 136 respectively, which extend transversely with respect to the cutting edge 126 of the wedge cutting portion 122.

The blades 130, 132 are preferrably arranged in a diverging relationship with respect to each other, and in a diverging relationship with respect to the deflecting face 124 of the wedge cutting portion 122. According to this diverging relationship, the wood chunks 28A, 28B, and 28C are discharged radially outwardly with respect to the center of the knife assembly in response to the shearing action. This clears the splitting station 32 with respect to all but one (28D) of the wood chunks.

Referring again to FIG. 4, the shearing action is enhanced by channels or grooves 138A, 138B and 138C which are formed in the shear plate 22. These grooves are aligned with the cutting edges of the wedge cutting portion 122 (FIG. 6), and the blades 130, 132, respectively.

The foregoing preferred embodiment of the invention has been shown and described herein for purposes of illustration only. Various changes in the structure as illustrated will no doubt occur to those skilled in the art. Such changes should be understood as being comprehended by the invention insofar as a fall within the spirit and scope of the appended claims.

What is claimed is:

1. Apparatus for producing wood chunks from a disc of wood comprising, in combination:

a housing including a base platform and a splitting station mounted on said platform;

a conveyor attached to said splitting station for conveying the discs of wood;

a shear plate secured to said housing in said splitting station and in the discharge path of said conveyor;

a ram mounted on said housing for vertical reciprocal movement relative to said shear plate;

a knife carried by said ram for splitting a disc of wood on said shear plate;

drive means enclosed within said housing and coupled to said ram for reciprocating it relative to said shear plate; and, a rotary hopper coupled to said conveyor and supported for rotation about an inclined axis, said hopper having an open upper end aligned with the discharge path of said conveyor and a lower open end, and sidewall openings for separating out wood portions of less than a predetermined maximum size.

* * * * *